US010563626B2

(12) United States Patent
Porter et al.

(10) Patent No.: US 10,563,626 B2
(45) Date of Patent: Feb. 18, 2020

(54) ELECTROSTATIC FLAME CONTROL TECHNOLOGY

(71) Applicant: United Technologies Corporation, Farmington, CT (US)

(72) Inventors: Steven D. Porter, Wethersfield, CT (US); Jon E. Sobanski, Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 16 days.

(21) Appl. No.: 16/020,021

(22) Filed: Jun. 27, 2018

(65) Prior Publication Data

US 2020/0003165 A1 Jan. 2, 2020

(51) Int. Cl.

| | |
|---|---|
| ***F02M 27/04*** | (2006.01) |
| ***F02B 51/04*** | (2006.01) |
| ***F23D 11/32*** | (2006.01) |
| ***F02B 23/10*** | (2006.01) |
| ***F23C 99/00*** | (2006.01) |
| ***F23D 11/24*** | (2006.01) |
| ***F02M 39/00*** | (2006.01) |

(52) U.S. Cl.

CPC ..... *F02M 27/04* (2013.01); *F02B 23/101* (2013.01); *F02B 51/04* (2013.01); *F02M 39/00* (2013.01); *F23C 99/001* (2013.01); *F23D 11/24* (2013.01); *F23D 11/32* (2013.01)

(58) Field of Classification Search

CPC .. F02M 27/04; F02M 2027/047; F02M 39/00; F02B 23/101; F02B 51/04; F23C 99/001; F23D 11/32

See application file for complete search history.

(56) References Cited

U.S. PATENT DOCUMENTS

| | | | | |
|---|---|---|---|---|
| 4,347,825 A * | 9/1982 | Suzuki | F02M 27/04 | 123/536 |
| 6,336,806 B1 | 1/2002 | Paschereit et al. | | |
| 8,955,325 B1 * | 2/2015 | Rubin | F23C 99/001 | 60/202 |

(Continued)

FOREIGN PATENT DOCUMENTS

RU 2615618 C1 4/2017

OTHER PUBLICATIONS

Deng, Weiwei, et al; Liquid Fuel Microcombustor Using Microfabricated Multiplexed Electrospray Sources; Proceeding of the Combustion Institute; 31 (2007) 2239-2246.

(Continued)

*Primary Examiner* — Jacob M Amick

(74) *Attorney, Agent, or Firm* — Cantor Colburn LLP

(57) ABSTRACT

A method of controlling fuel injection into a combustor of a gas turbine engine including: applying a first electrical charge to fuel such that the fuel becomes a charged fuel; and applying a second electrical charge to a component of the combustor, wherein the first electrical charge is applied to the fuel at a first frequency and the second electrical charge is applied to the component at a second frequency such that at least one of a selected tone, a selected screech, and a selected noise is produced by spraying the charged fuel through the component and into a combustion chamber of the combustor from a fuel nozzle.

20 Claims, 6 Drawing Sheets

(56) References Cited

U.S. PATENT DOCUMENTS

| | | | | |
|---|---|---|---|---|
| 9,151,252 | B2 | 10/2015 | Hernandez et al. | |
| 9,188,332 | B2 | 11/2015 | Louste et al. | |
| 2001/0045474 | A1 | 11/2001 | Wilbraham | |
| 2012/0023950 | A1* | 2/2012 | Weeks | F23C 99/001 60/722 |

OTHER PUBLICATIONS

Gomez, Alessandro; The Electrospray: Fundamentals and Combustion Applications; https://ntrs.nasa.gov/search.jsp?R=19930011029 2019-11-14T12:13:32+00:00Z; Feb. 1, 1993; pp. 325-330.

Ju, Yiguang, et al; Microscale Combustion: Technology Development and Fundamental Research; Progress in Energy and Cobustion Science 37 (2011) 669-715.

The Partial European Search Report for Application No. 19183017.3-1009; Report dated Sep. 2, 2019; dated Oct. 9, 2019; 16 pages.

* cited by examiner

ELECTROSTATIC FLAME CONTROL TECHNOLOGY

BACKGROUND

The subject matter disclosed herein generally relates to gas turbine engines and, more particularly, to a method and apparatus for fuel injection control in combustors of gas turbine engines.

A gas turbine engine, typically used as a source of propulsion in aircraft, operates by drawing in ambient air, combusting that air with a fuel, and then forcing the exhaust from the combustion process out of the engine. A fan and compressor section, having a low and high pressure compressor, rotate to draw in and compress the ambient air. The compressed air is then forced into the combustor, where it is split. A portion of the air is used to cool the combustor while the rest is mixed with a fuel and combusted.

The combustor includes fuel injector, which is a device for dispersing fuel into the combustor to be combusted. The fuel enters a nozzle which atomizes the fuel to allow for greater air-fuel mixing before the combustion process. Conventionally, once the fuel injector is designed and installed, there is little ability to change performance aspects of the fuel injector, such as, for example, fuel spray angle, fuel spray atomization, and fuel spray breadth.

SUMMARY

According to an embodiment, a method of controlling fuel injection into a combustor of a gas turbine engine is provided. The method including: applying a first electrical charge to fuel such that the fuel becomes a charged fuel; and applying a second electrical charge to a component of the combustor, the first electrical charge is applied to the fuel at a first frequency and the second electrical charge is applied to the component at a second frequency such that at least one of a selected tone, a selected screech, and a selected noise is produced by spraying the charged fuel through the component and into a combustion chamber of the combustor from a fuel nozzle.

In addition to one or more of the features described herein, or as an alternative, further embodiments may include that a polarity or magnitude of at least one of the first electrical charge and the second electrical charge is adjusted to adjust a conical angle of the charged fuel being sprayed by the fuel nozzle.

In addition to one or more of the features described herein, or as an alternative, further embodiments may include that the first electrical charge and the second electrical charge have an opposite charge polarity.

In addition to one or more of the features described herein, or as an alternative, further embodiments may include that the first electrical charge and the second electrical charge have an equivalent charge polarity.

In addition to one or more of the features described herein, or as an alternative, further embodiments may include that the component is a charged ring located within the combustor of the gas turbine engine or within the fuel nozzle of the gas turbine engine.

In addition to one or more of the features described herein, or as an alternative, further embodiments may include that the component is the fuel nozzle.

In addition to one or more of the features described herein, or as an alternative, further embodiments may include that the component is an outer wall of the combustor and an inner wall of the combustor.

According to another embodiment, a fuel injection control system for use in a combustor of a gas turbine engine is provided. The fuel injection control system including: a charge controller configured to apply a first electrical charge to fuel such that the fuel becomes a charged fuel and apply a second electrical charge to a component of the combustor or fuel nozzle; and a fuel nozzle configured to spray the charged fuel through the component and into a combustion chamber of the combustor, the first electrical charge is applied to the fuel at a first frequency and the second electrical charge is applied to the component at a second frequency such that at least one of a selected tone, a selected screech, and a selected noise is produced by spraying the charged fuel through the component and into a combustion chamber of the combustor from the fuel nozzle.

In addition to one or more of the features described herein, or as an alternative, further embodiments may include that a polarity or a magnitude of at least one of the first electrical charge and the second electrical charge is adjusted to adjust a conical angle of the charged fuel being sprayed by the fuel nozzle.

In addition to one or more of the features described herein, or as an alternative, further embodiments may include that the first electrical charge and the second electrical charge have an opposite charge polarity.

In addition to one or more of the features described herein, or as an alternative, further embodiments may include that the first electrical charge and the second electrical charge have an equivalent charge polarity.

In addition to one or more of the features described herein, or as an alternative, further embodiments may include that the component is a charged ring located within the combustor of the gas turbine engine or within the fuel nozzle of the gas turbine engine.

In addition to one or more of the features described herein, or as an alternative, further embodiments may include that the component is fuel nozzle.

In addition to one or more of the features described herein, or as an alternative, further embodiments may include that the component is an outer wall of the combustor and an inner wall of the combustor.

According to another embodiment, a fuel injection control system for use in a combustor of a gas turbine engine is provided. The fuel injection control system including: a charge controller configured to apply a first electrical charge to fuel such that the fuel becomes a charged fuel and apply a second electrical charge to a component of the combustor; a fuel nozzle configured to spray the charged fuel through the component and into a combustion chamber of the combustor; and an amperage reader electrically connected to the component and the charge controller, the amperage reader is configured to detect a change in amperage of electrical current flowing through the component and transmit the change of amperage to the charge controller, the charge controller is configured to adjust a polarity or a magnitude of at least one of the first electrical charge or second electrical charge in response to the amperage detected.

In addition to one or more of the features described herein, or as an alternative, further embodiments may include that the electrical change in amperage of electrical current flowing through the component is caused by the charged fuel touching down on the component.

In addition to one or more of the features described herein, or as an alternative, further embodiments may include that the polarity or magnitude of at least one of the first electrical charge and the second electrical charge is adjusted to adjust a conical angle of the charged fuel being sprayed by the fuel nozzle.

In addition to one or more of the features described herein, or as an alternative, further embodiments may include that the first electrical charge and the second electrical charge have an opposite charge polarity.

In addition to one or more of the features described herein, or as an alternative, further embodiments may include that the first electrical charge and the second electrical charge have an equivalent charge polarity.

In addition to one or more of the features described herein, or as an alternative, further embodiments may include that the component is a charged ring located within the combustor of the gas turbine engine or within the fuel nozzle.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

The detailed description explains embodiments of the present disclosure, together with advantages and features, by way of example with reference to the drawings.

DETAILED DESCRIPTION

A detailed description of one or more embodiments of the disclosed apparatus and method are presented herein by way of exemplification and not limitation with reference to the Figures.

Figure 1:
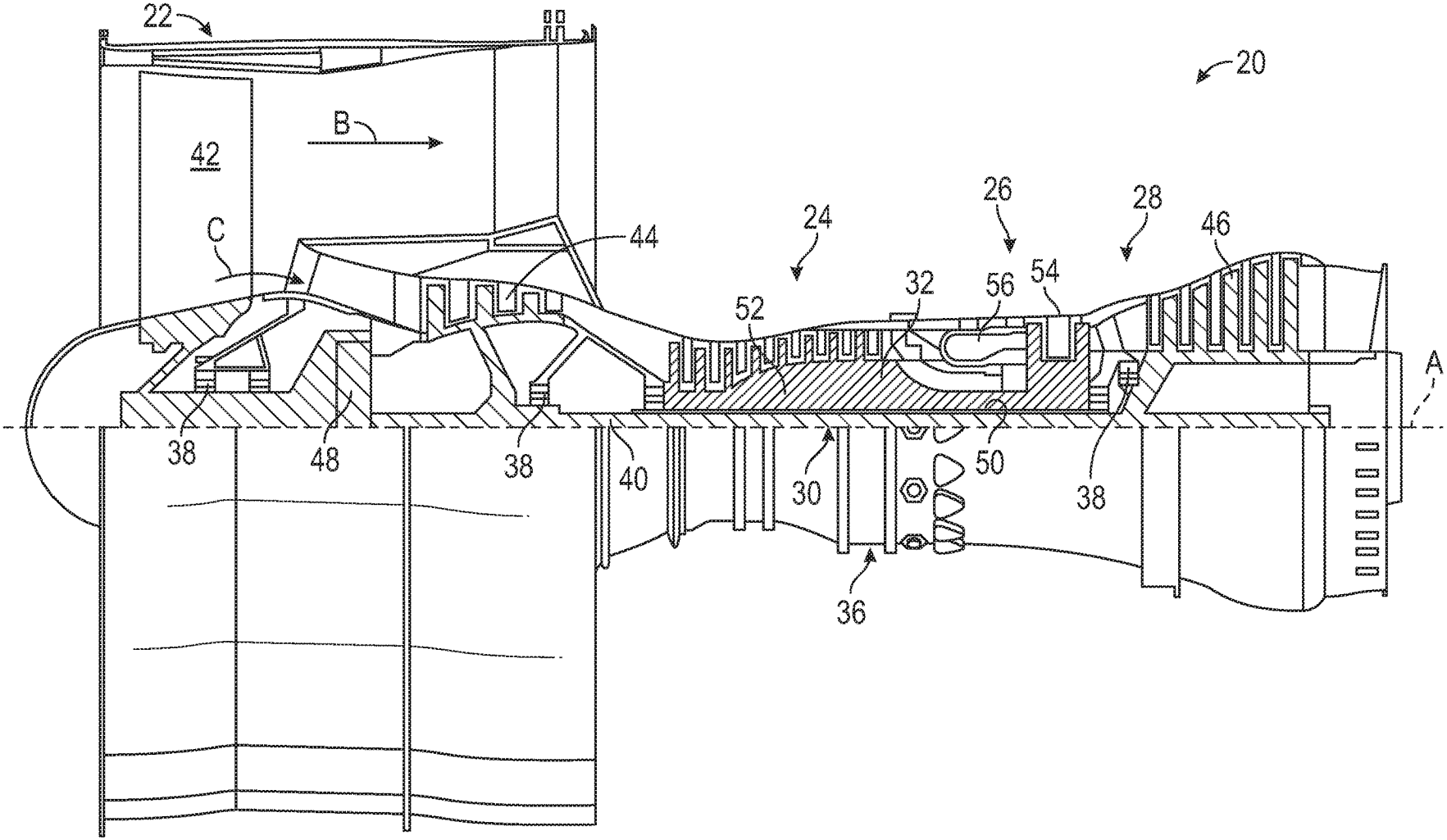
FIG. 1 is a partial cross-sectional illustration of a gas turbine engine, in accordance with an embodiment of the disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 m/sec).

Figure 2:
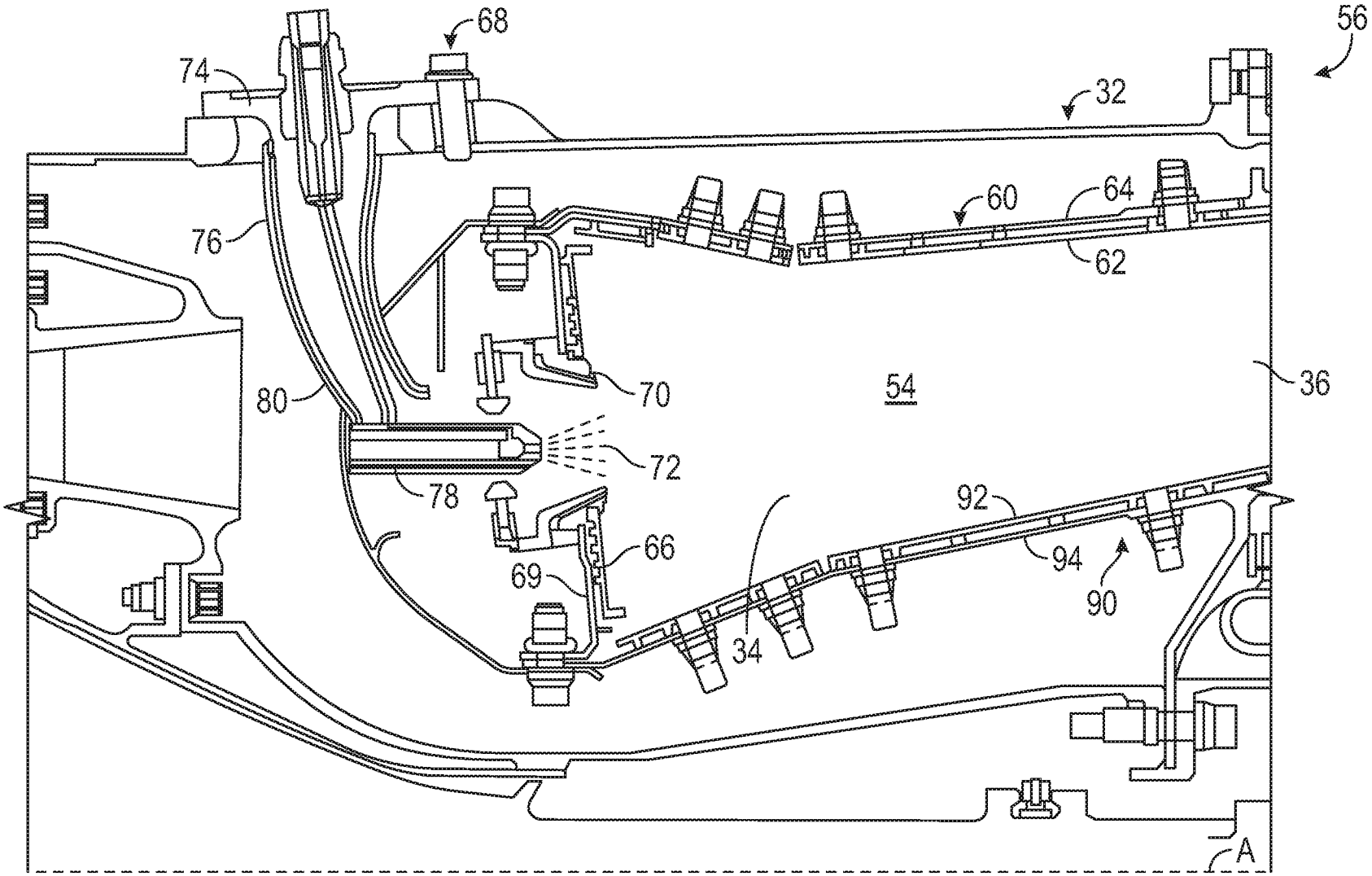
FIG. 2 is a cross-sectional illustration of a combustor for use in the gas turbine engine of FIG. 1, in accordance with an embodiment of the disclosure.

Referring now to FIG. 2, the combustor 56 is depicted as a double-walled annular combustor, centered on the central axis A. However, any form of combustor may be utilized with the present disclosure such as, but not limited to, a single-wall annular combustor or a can combustor. The annular combustor 56 has an outer wall 60 and an inner wall 90 radially interior to and circumscribed by the outer wall 60. The walls 60, 90 define, and are separated by, an annular combustion chamber 54. The outer wall 60 includes an outer shell 64 and an outer liner 62, while and the inner wall 90 includes an inner shell 94 and an inner liner 92. Each of the liners 62 and 92 are positioned within the combustion chamber 54 and connected to its associated shell to protect the shells 64 and 94 from high temperatures in the combustion chamber 54. A bulkhead 69 extends from the inner wall 90 to the outer wall 60 at a forward end of the forward section 34 of the combustor 56 and has a heat shield 66 mounted thereupon to protect the bulkhead 69 from high temperatures in the combustion chamber 54. The aft section 36 of the combustor 56 is open to allow exhaust from the combustion process to exit the combustor 56 and enter into the turbine section 28.

At least one fuel injector 78 extends into the combustion chamber 54 through the bulkhead 69. A swirler 70 may be generally positioned around the fuel injector 78 such that compressed air may be admitted through the swirler 70 to be mixed with a fuel 72 provided by the fuel injector 78. The swirler 70 may increase the turbulence in the air traveling through the swirler 70, which may increase the mixing of the air and fuel 72. The fuel injector 78, as shown in FIG. 3, has a mount 74 to secure the fuel injector 78 to the engine 20 and a radial support 76 extending radially inward from the mount 72 to a nozzle 78, which extends axially through the bulkhead 69 to the combustion chamber.

Conventional ability to control fuel, fuel-air, and flame within the combustor 56 of gas turbine engines 20 after the hardware of the combustor 56 has been installed is very limited, which means relying heavily on analysis and iterative builds up front to meet desired combustion, operability, and durability requirements. This process is expensive and time consuming. Additionally a combustor configuration that improves panel durability often results in decreased relight ability and operability. Relight ability being the ability to restart the combustion process of the gas turbine engine 20 after the combustion process has ceased. Embodiments disclosed herein seek to address the ability to control fuel, fuel-air, and flame within the combustor 56 of gas turbine engines 20 after the hardware of the combustor 56 has been installed.

Figure 3:
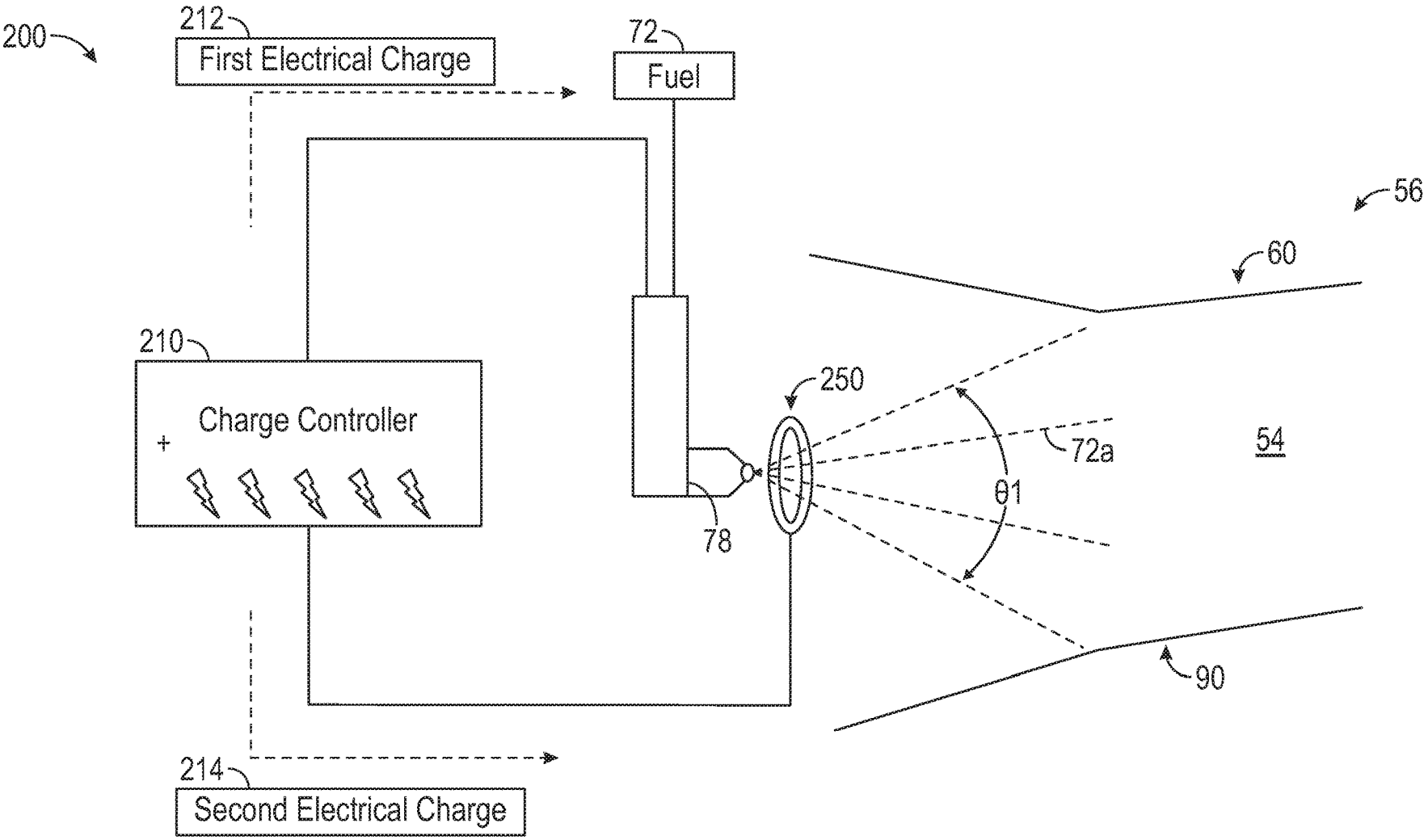
FIG. 3 is a block diagram illustration of a fuel injection control system for use in the combustor of FIG. 2, in accordance with an embodiment of the disclosure.
Figure 4:
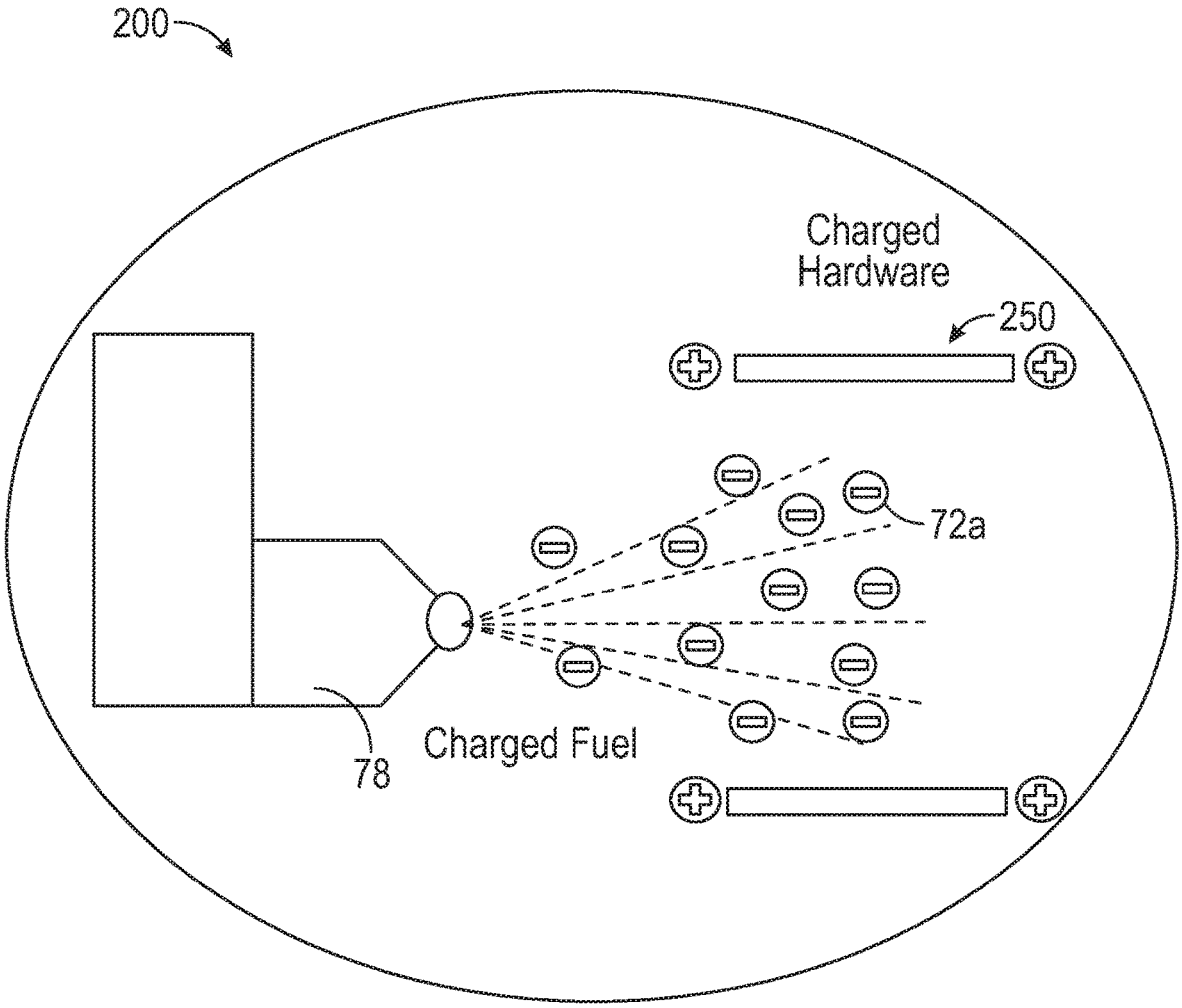
FIG. 4 is an example of the charge polarity of charged fuel and a charged component for the fuel injection control system of FIG. 3, in accordance with an embodiment of the disclosure.
Figure 5:
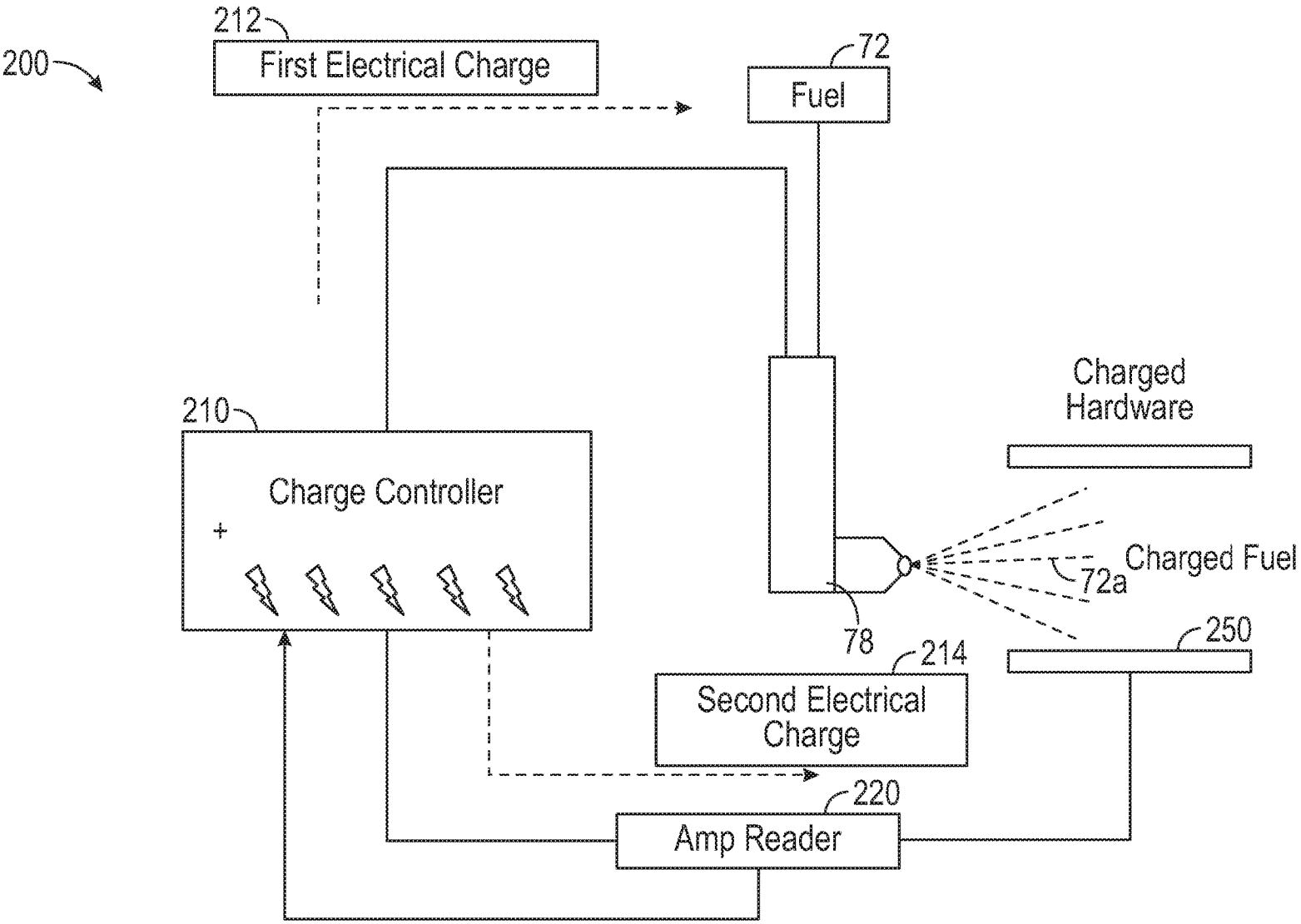
FIG. 5 is an block diagram illustration of a fuel injection control system for use in the combustor of FIG. 2, in accordance with an embodiment of the disclosure.

Referring now to FIGS. 3-5 with continued reference to FIGS. 1 and 2. FIGS. 3 and 4 illustrate a fuel injection control system 200 configured to actively control fuel 72, fuel-air, and flame within the combustor 56 of gas turbine engines 20 in real-time. As shown in FIG. 3, the fuel injection control system 200 includes a charge controller 210 configured to apply a first electrical charge 212 to fuel 72, such that the fuel 72 becomes a charged fuel 72*a*. The charge controller 210 is also configured to apply a second electrical charge 214 to a component 250 of the combustor 56. The first electrical charge 212 may be applied to the fuel 72 prior to the fuel 72 reaching the fuel nozzle 78 or the first electrical charge 212 may be applied to the fuel 72 at the fuel nozzle 78. The fuel nozzle 78 is configured to spray the charged fuel 72*a* through the component 250 and into a combustion chamber 54 of the combustor 56. In an embodiment, the first electrical charge 212 is applied to the fuel 72 at a first frequency and the second electrical charge 214 is applied to the component 250 at a second frequency such that at least one of a selected tone is produced by spraying the charged fuel 72*a*, a selected screech is produced by spraying the charged fuel 72*a*, and a selected noise is produced by spraying the charged fuel 72*a*. Advantageously, by changing the at least one of the first electrical charge 212 and the second electrical charge 214 at least one of the selected tone produced by spraying the charged fuel 72*a*, the selected screech produced by spraying the charged fuel 72*a*, and the selected noise produced by spraying the charged fuel 72*a* may be controlled and adjusted to help avoid a natural resonance frequency that may damage the combustor 56.

The noise, tone, and screech of the gas turbine engine are a harmonic acoustic environment that can detrimentally affect engine noise levels or the long term well-being of components excited by or near said acoustic environment. Noise is the overall acoustic output of the combustor 56. A selected noise may be a noise having specific sound characteristics including but not limited to specific values of amplitude, frequency, wavelength, and decibel level of the noise.

Combustion instability is commonly referred to as "tonal noise (tonal noise)". The tonal noise which May not only discomfort to people in and around the aircraft, the vibration caused by tone noise, causing damage to the aircraft part including the engine parts. A selected tone may be a tone having specific sound characteristics including but not limited to specific values of amplitude, frequency, wavelength, and decibel level of the tone.

Augmentors or "afterburners" provide an increase in thrust generated by a gas turbine engine 20. Fuel 72 is sprayed into a core stream and ignited to produce the desired additional thrust. The fuel 72 is fed into the core stream C in the combustor 56. Combustor screech results when natural modes of the combustor couple with unsteady heat released by a combustion flame. Uniform heat release perturbation across the duct combines with the natural modes to produce the strongest screech. A selected screech may be a screech having specific sound characteristics including but not limited to specific values of amplitude, frequency, wavelength, and decibel level of the screech.

In an embodiment the polarity of the first electrical charge 212 and the second electrical charge 214 may be adjusted in real-time to adjust at least one of the conical angle θ1 of the charged fuel 72*a*, the selected tone produced by spraying the charged fuel 72*a*, the selected screech produced by spraying the charged fuel 72*a*, and the selected noise produced by spraying the charged fuel 72*a*. In an embodiment, the first electrical charge 212 and the second electrical charge 214 have an opposite charge polarity, such that one electrical charge 212, 214 may be positive and the other electrical charge 212, 214 may be negative. In the example shown in FIG. 4, the charged fuel 72*a* is negative and the component 250 is positive, thus the charged fuel 72*a* that is negatively charged is attracted to the component 250 that is positively charged. In an embodiment, the polarity of the charged fuel 72*a* and the component 250 may be changed in real-time. In an embodiment, the first electrical charge 212 and the second electrical charge 214 have an equivalent charge polarity. In an example, the first electrical charge 212 and the second electrical charge 214 may be a negative charge, such that the charged fuel 72*a* that is negatively charged is repelled away from the component 250 that is negatively charged. Additionally, in another embodiment, the magnitude of at least one of the first electrical charge 212 and the second electrical charge 214 may be adjusted in real-time to adjust at least one of the conical angle θ1 of the charged fuel 72*a*, the selected tone produced by spraying the charged fuel 72*a*, the selected screech produced by spraying the charged fuel 72*a*, and the selected noise produced by spraying the charged fuel 72*a*.

In an embodiment, the component 250 may be a charged ring located within the combustor 250 of the gas turbine engine 20, as shown in FIGS. 3 and 4. In another embodiment, the component 250 is a charged ring located within the fuel nozzle 78 of the gas turbine engine 20. In another embodiment, the component 250 is the fuel nozzle 78. In another embodiment, the component 250 may be the outer wall 60 and the inner wall 90. For example, the component 250 may be the liners 62 and 92 and/or the shells 64 and 94. The liners 62 and 92 and/or the shells 64 and 94 may be electrically charged with the second electrical charge 214 to either attract or repel the charged fuel 72*a*.

In the embodiment shown in FIG. 5, the fuel injection control system 200 also includes an amperage reader 220 that is electrically connected to the component 250 and the charge controller 210. As charged fuel 72*a* impacts the component 250, the amperage of electrical current flow through the component 250 will change, which will give charge controller 210 a way to detect how much charged fuel 72*a* is touching down on the component 250. The change in electrical current flowing through the component 250 is facilitated by a change in electrical charge created by the touch down of charge fuel 72*a* on a differently charged component 250. The amperage reader 220 is configured to detect a change in amperage of electrical current flow through the component 250 and transmit the change of amperage to the charge controller 210. The charge controller 210 is configured to adjust a polarity or magnitude of at least one of the first electrical charge 212 or second electrical charge 214 in response to the amperage detected. The utilization of the amperage reader 220 creates a closed-feedback loop, such that real-time updates may be performed for at least one of the conical angle θ1 of the charged fuel 72*a*, the selected tone produced by spraying the charged fuel 72*a*, the selected screech produced by spraying the charged fuel 72*a*, and the selected noise produced by spraying the charged fuel 72*a*. Advantageously, the gas turbine engine 20 will see improvements to durability and relight ability by actively changing the conical angle θ1 of the charged fuel 72*a* in response to the touchdown of fuel on the component 250.

Figure 6:
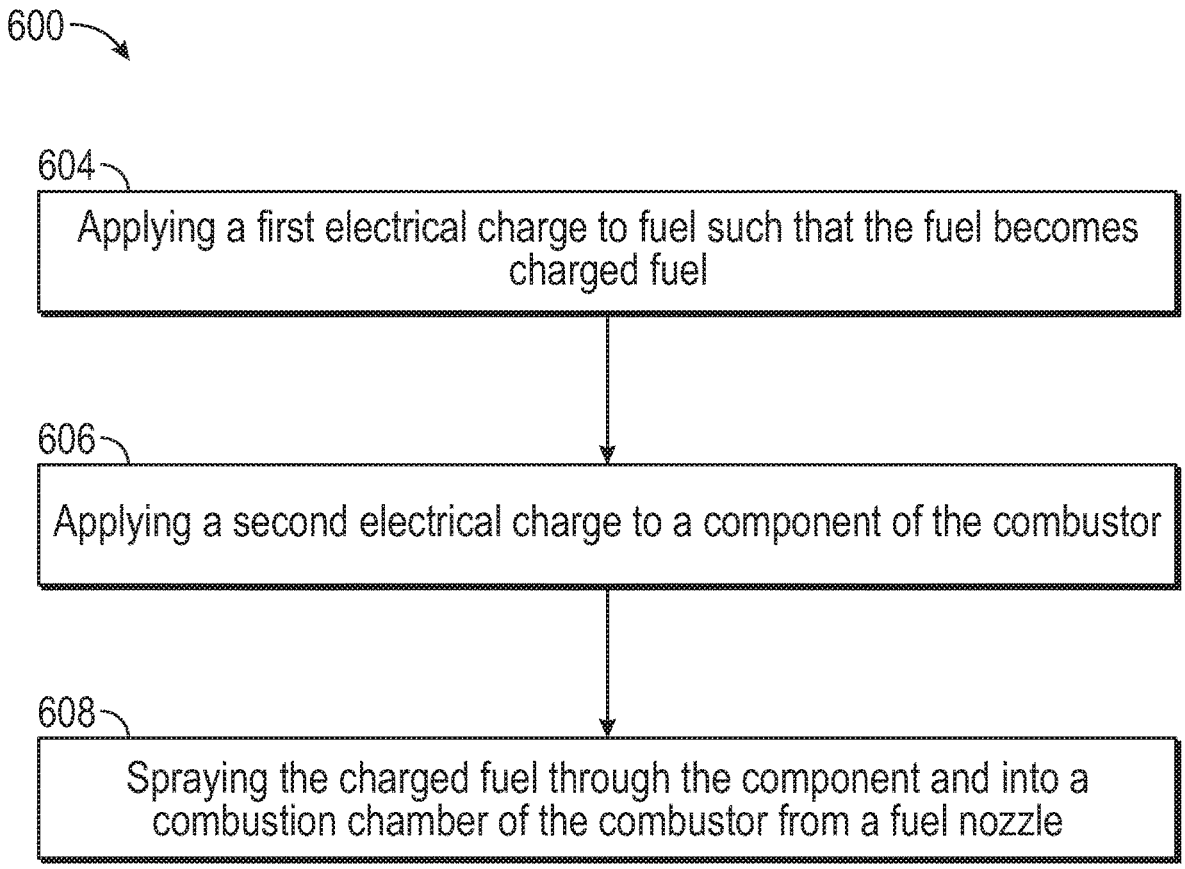
FIG. 6 is an illustration of a method of controlling fuel injection into the combustor of FIG. 2, in accordance with an embodiment of the disclosure.

Referring now to FIG. 6 with continued reference to FIGS. 1-5. FIG. 6 illustrates a method 600 of controlling fuel injection into a combustor 56 of a gas turbine engine 20. At block 604, a first electrical charge 212 is applied to fuel 72 such that the fuel 72 becomes a charged fuel 72*a*. At block 606, a second electrical charge 214 is applied to a component 250 of the combustor 56. At block 608, the charged fuel 72*a* is sprayed through the component 250 and into a combustion chamber 54 of the combustor 56 from a fuel nozzle 78. In an embodiment, the first electrical charge 212 is applied to the fuel at a first frequency and the second electrical charge 214 is applied to the component 250 at a second frequency such that at least one of a selected tone is produced by spraying the charged fuel 72*a*, a selected screech is produced by spraying the charged fuel 72*a*, and a selected noise is produced by spraying the charged fuel 72*a*. In an embodiment, the first frequency and the second frequency may be equivalent. In another embodiment, the first frequency and the second frequency may not be equivalent. In another embodiment, at least one of the first frequency and the second frequency may be equal to zero (i.e., no frequency).

Technical effects of embodiments of the present disclosure include applying an electrical charge to fuel and then utilizing charge attractions and/or repulsion to adjust at least one of the conical angle of the charged fuel, the selected tone produced by spraying the charged fuel, the selected screech produced by spraying the charged fuel, and the selected noise produced by spraying the charged fuel.

The term "about" is intended to include the degree of error associated with measurement of the particular quantity based upon the equipment available at the time of filing the application. For example, "about" can include a non-limiting range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of controlling fuel injection into a combustor of a gas turbine engine, the method comprising:

applying a first electrical charge to fuel such that the fuel becomes a charged fuel; and applying a second electrical charge to a component of the combustor, wherein the first electrical charge is applied to the fuel at a first frequency and the second electrical charge is applied to the component at a second frequency such that at least one of a selected tone, a selected screech, and a selected noise is produced by spraying the charged fuel through the component and into a combustion chamber of the combustor from a fuel nozzle.

2. The method of claim 1, wherein a polarity or magnitude of at least one of the first electrical charge and the second electrical charge is adjusted to adjust a conical angle of the charged fuel being sprayed by the fuel nozzle.

3. The method of claim 1, wherein the first electrical charge and the second electrical charge have an opposite charge polarity.

4. The method of claim 1, wherein the first electrical charge and the second electrical charge have an equivalent charge polarity.

5. The method of claim 1, wherein the component is a charged ring located within the combustor of the gas turbine engine or within the fuel nozzle of the gas turbine engine.

6. The method of claim 1, wherein the component is the fuel nozzle.

7. The method of claim 1, wherein the component is an outer wall of the combustor and an inner wall of the combustor.

8. A fuel injection control system for use in a combustor of a gas turbine engine, the fuel injection control system comprising:

a charge controller configured to apply a first electrical charge to fuel such that the fuel becomes a charged fuel and apply a second electrical charge to a component of the combustor or fuel nozzle; and a fuel nozzle configured to spray the charged fuel through the component and into a combustion chamber of the combustor, wherein the first electrical charge is applied to the fuel at a first frequency and the second electrical charge is applied to the component at a second frequency such that at least one of a selected tone, a selected screech, and a selected noise is produced by spraying the charged fuel through the component and into a combustion chamber of the combustor from the fuel nozzle.

9. The fuel injection control system of claim 8, wherein a polarity or a magnitude of at least one of the first electrical charge and the second electrical charge is adjusted to adjust a conical angle of the charged fuel being sprayed by the fuel nozzle.

10. The fuel injection control system of claim 8, wherein the first electrical charge and the second electrical charge have an opposite charge polarity.

11. The fuel injection control system of claim 8, wherein the first electrical charge and the second electrical charge have an equivalent charge polarity.

12. The fuel injection control system of claim 8, wherein the component is a charged ring located within the combustor of the gas turbine engine or within the fuel nozzle of the gas turbine engine.

13. The fuel injection control system of claim 8, wherein the component is fuel nozzle.

14. The fuel injection control system of claim 8, wherein the component is an outer wall of the combustor and an inner wall of the combustor.

15. A fuel injection control system for use in a combustor of a gas turbine engine, the fuel injection control system comprising:

a charge controller configured to apply a first electrical charge to fuel such that the fuel becomes a charged fuel and apply a second electrical charge to a component of the combustor;

a fuel nozzle configured to spray the charged fuel through the component and into a combustion chamber of the combustor; and an amperage reader electrically connected to the component and the charge controller, wherein the amperage reader is configured to detect a change in amperage of electrical current flowing through the component and transmit the change of amperage to the charge controller, wherein the charge controller is configured to adjust a polarity or a magnitude of at least one of the first electrical charge or second electrical charge in response to the amperage detected.

16. The fuel injection control system of claim 15, wherein the electrical change in amperage of electrical current flowing through the component is caused by the charged fuel touching down on the component.

17. The fuel injection control system of claim 15, wherein the polarity or magnitude of at least one of the first electrical charge and the second electrical charge is adjusted to adjust a conical angle of the charged fuel being sprayed by the fuel nozzle.

18. The fuel injection control system of claim 15, wherein the first electrical charge and the second electrical charge have an opposite charge polarity.

19. The fuel injection control system of claim 15, wherein the first electrical charge and the second electrical charge have an equivalent charge polarity.

20. The fuel injection control system of claim 15, wherein the component is a charged ring located within the combustor of the gas turbine engine or within the fuel nozzle.

* * * * *